United States Patent [19]

Brull et al.

[11] Patent Number: 4,867,590

[45] Date of Patent: Sep. 19, 1989

[54] DOT MATRIX PRINT HEAD CARRIAGE WITH SWINGABLE HEAT SINK

[75] Inventors: Robert A. Brull, Dryden; Alan H. Walker, Barton, both of N.Y.

[73] Assignee: NCR Corporation, Dayton, Ohio

[21] Appl. No.: 176,956

[22] Filed: Apr. 4, 1988

[51] Int. Cl.[4] ..... B41J 11/22

[52] U.S. Cl. ..... 400/352; 400/124; 400/175

[58] Field of Search ..... 400/124, 175, 320, 352, 400/355, 356, 358, 692, 719

[56] References Cited

U.S. PATENT DOCUMENTS

| | | | |
|---|---|---|---|
| 4,064,984 | 12/1977 | Toeppen | 400/175 |
| 4,134,695 | 1/1979 | Randolph | 400/320 |
| 4,229,114 | 10/1980 | Van Horne | 400/692 |
| 4,239,402 | 12/1980 | Jung et al. | 400/175 |
| 4,389,128 | 6/1983 | Asano et al. | 400/124 TC |
| 4,469,454 | 9/1984 | Crean | 400/144.2 |
| 4,473,312 | 9/1984 | Forschner | 400/175 |
| 4,514,100 | 4/1985 | La Spesa | 400/55 |
| 4,708,502 | 11/1987 | Murakami | 400/175 |

FOREIGN PATENT DOCUMENTS

| | | | |
|---|---|---|---|
| 148671 | 9/1982 | Japan | 400/621 |
| 224380 | 12/1984 | Japan | 400/175 |
| 183166 | 9/1985 | Japan | 400/124 TC |
| 217259 | 9/1986 | Japan | 400/12 Y |

*Primary Examiner*—David A. Wiecking

*Attorney, Agent, or Firm*—Wilbert Hawk, Jr.; Albert L. Sessler, Jr.; George J. Muckenthaler

[57] ABSTRACT

A dot matrix print head has a heat sink substantially surrounding the head for dissipating heat therefrom. A print head carriage includes a pivot or bearing assembly on one side of the print head and includes a bail type clamp pivoted on the carriage on the other side of the print head. The arrangement allows the heat sink to swing from a covered print head operating position to an uncovered position for servicing or for removing the print head.

16 Claims, 3 Drawing Sheets

DOT MATRIX PRINT HEAD CARRIAGE WITH SWINGABLE HEAT SINK

CROSS REFERENCE TO RELATED APPLICATION

Application entitled "Dot Matrix Printer Carriage", Ser. No. 176,957, filed Apr. 4, 1988, invented by James R. Del Signore, Robert A. Brull, and Alan H. Walker, and assigned to NCR Corporation.

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like media while the carriage and print head are moved above and across the form or media in the horizontal direction.

In the dot matrix printer which includes a print head of the circular configuration and multiple element type, there is a requirement for movement of generated heat away from the print head. These print heads operate at high speed and at large loading in a compact environment so that such generated heat is disposed of through means of a heat sink. The heat sink surrounds at least a portion of the print head to transfer the heat to and through the heat sink by conduction and convection.

Representative documentation in the field of dot matrix printer heads includes U.S. Pat. No. 4,134,695, issued to J. E. Randolph on Jan. 16, 1979, which discloses a carriage for positioning a print mechanism with facility for retracting the print mechanism.

U.S. Pat. No. 4,064,984, issued to T. H. Toeppen on Dec. 27, 1977, discloses a releasable device for fastening a print head and includes a manually-operated control lever which effects the opening and closing of a pair of locking levers by cam action in the form of journal bearings in the control lever.

U.S. Pat. No. 4,229,114, issued to A. C. Van Horne on Oct. 21, 1980, discloses a mechanism for mounting a print head to the shuttle of a printer and is designed to facilitate easy removal and replacement of the print head. The shuttle includes two slots for receiving molded bosses of the print head. The shuttle also has two locking members which are spring loaded to secure the parts.

U.S. Pat. No. 4,239,402, issued to F. Jung et al. on Dec. 16, 1980, discloses a wire matrix print head configured for detachable mounting on a complementary shaped support and held thereto by a spring device which urges the complementary surfaces in secure contact with one another.

U.S. Pat. No. 4,469,454, issued to G. J. Crean on Sept. 4, 1984, discloses a print wheel mounting arrangement for a print head and ribbon cartridge assembly that provides for tilting the assembly into a inoperative position with the ribbon cartridge in an extended tilted position for removal and replacement of the print wheel.

U.S. Pat. No. 4,473,312, issued to E. Forschner on Sept. 25, 1984, discloses a fastening mechanism for removably fastening a print head housing and a carriage. A locking member on the carriage effects rotational and axial movement relative thereto and has abutment surfaces cooperating with cam surfaces on the housing to latch the housing and the carriage by action of a spring.

U.S. Pat. No. 4,514,100, issued to R. E. La Spesa on Apr. 30, 1985, discloses apparatus for mounting a print head on a movable carriage and includes a projection on the carriage, an opening in the print head to receive the projection, a compression spring for maintaining the projection in the opening, and a movable cam surface in contact with the projection.

And, U.S. Pat. No. 4,708,502, issued to K. Murakami on Nov. 24, 1987, discloses a mounting mechanism for releasably mounting a print head to a carriage which includes a pair of pivotable levers located on opposite sides of the print head. A spring biases the levers in a predetermined direction and the levers are pivotable between a print head secured position and a print head released position.

SUMMARY OF THE INVENTION

The present invention is directed to printers and more particularly to a dot matrix print head on a movable carriage. The carriage is of unitary construction and includes a plurality of bearings which ride along guide rails or shafts of the printer. The guide shafts are attached to side frames or plates of the printer and the carriage is moved by means of an electric motor in transverse direction.

The dot matrix print head is supported on the carriage and includes a plurality of actuating coils for driving print wires in printing operation as the print head and carriage assembly is moved back and forth across the printer.

A heat sink is swingably supported from the carriage in an arrangement wherein the heat sink is pivoted at one side and is latched at the other side. The heat sink substantially surrounds the print head to transfer heat from the print head to and through the heat sink by conduction and convection methods.

A knife assembly is also provided and is supported on the top surface of the heat sink. The knife assembly includes a solenoid actuator that moves a circular knife from a cam into cutting position for severing record media such as receipt paper. The cutting action may involve either partial or full cutting of the paper as the carriage is moved across the printer.

In view of the above discussion, a principal object of the present invention is to provide a dot matrix print head with heat transfer means.

Another object of the present invention is to provide a dot matrix print head carrying a swingable heat sink thereon.

An additional object of the present invention is to provide a print head assembly having heat transfer means and media cutting means.

A further object of the present invention is to provide a dot matrix print head supported from a carriage with pivot means for enabling swingable movement of a heat sink and a knife assembly to permit access to the print head.

Additional advantages and features of the present invention will become apparent and fully understood from a reading of the following description taken together with the annexed drawing.

DESCRIPTION OF THE PREFERRED EMBODIMENT

Figure 1:
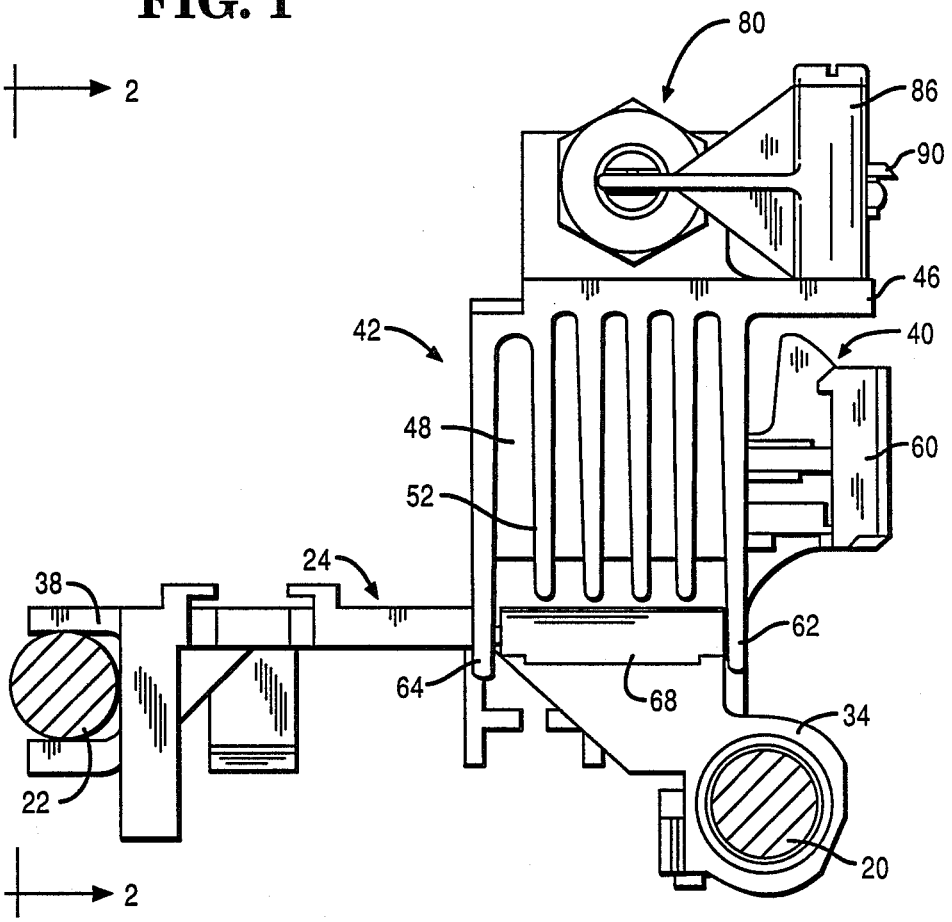
FIG. 1 is a side elevational view of a print head assembly incorporating the structure of the present invention.
Figure 2:
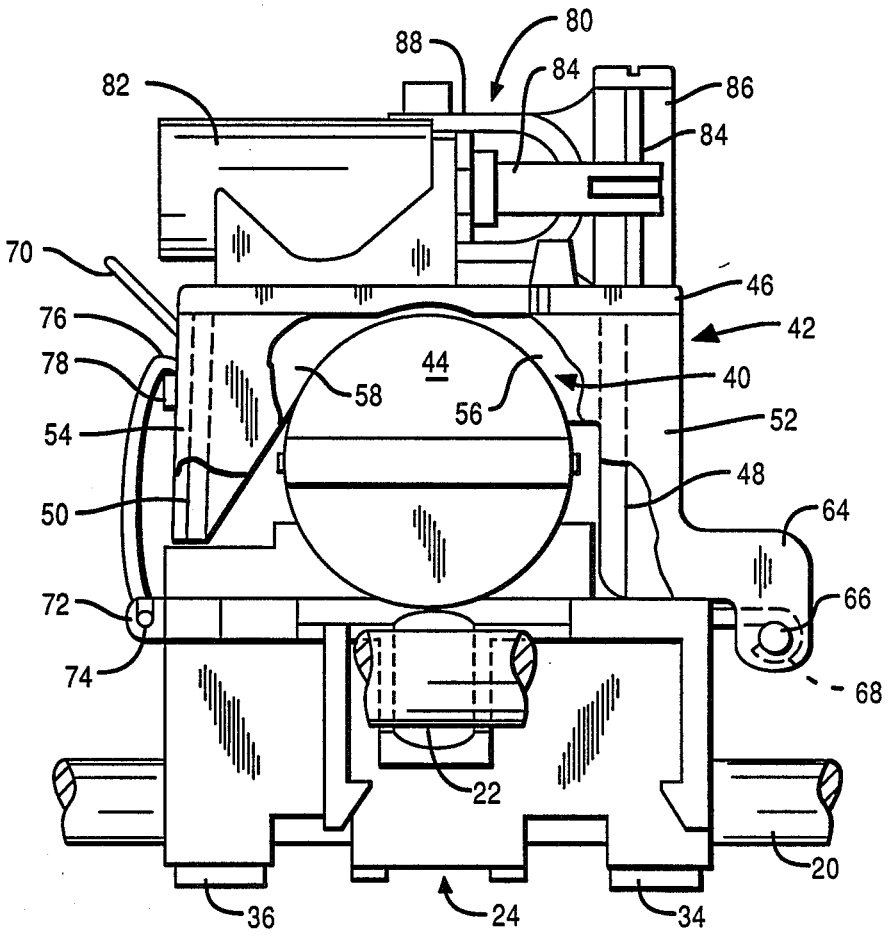
FIG. 2 is an elevational view taken on the line 2—2 of FIG. 1.
Figure 3:
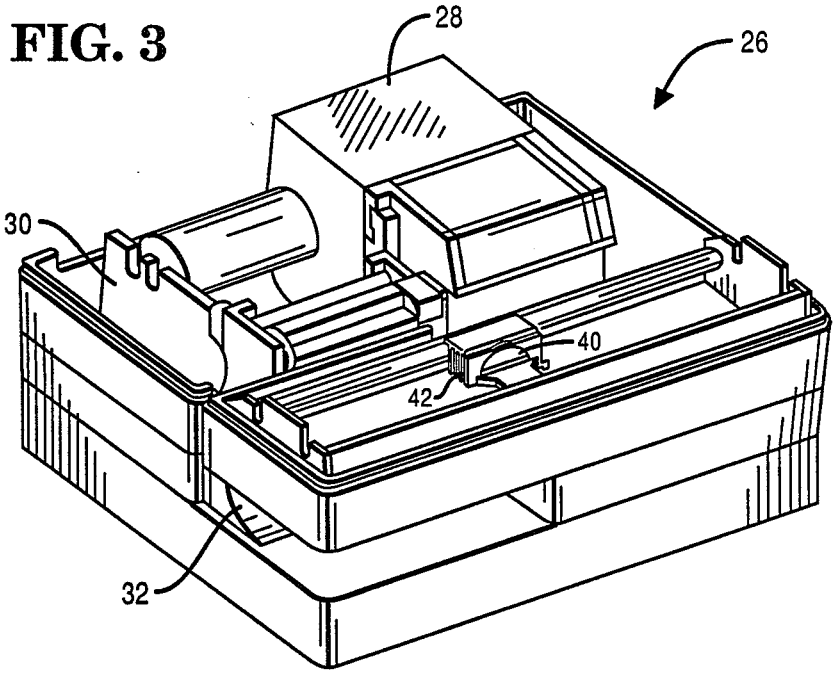
FIG. 3 is a perspective view of a printer incorporating the subject matter of the present invention.

FIGS. 1 and 2 illustrate a side elevational view and a front elevational view, respectively, of the print head assembly of the present invention. A pair of guide rails or shafts 20 and 22 carry a carriage 24 in transverse manner across a printer 26 of the type, as shown in FIG. 3. The printer includes a journal station 28, a receipt station 30, and a slip station 32. The journal station 28 is positioned on the right hand side of the printer 26 and the receipt station 30 and the slip station 32 occupy the left hand side of the printer. A more detailed description of the printer 26 is found in co-pending U.S. application Ser. No. 67,757, filed June 29, 1987, now U.S. Pat. No. 4,780,007, issued Oct. 25, 1988, and assigned to the same assignee as the present application.

The carriage 24 is of unitary construction and includes a pair of spaced bearings 34 and 36 at the rear part of the carriage. The carriage 24 has a single bearing 38 of U-shaped construction at the front part. The details of the carriage 24 are more fully described in the co-pending U.S. application Ser. No. 176,957, filed Apr. 4, 1988, and assigned to the same assignee as the present application.

A print head 40 of the dot matrix type in a circular configuration (FIG. 2) is mounted on the carriage 24. The print head includes a plurality of print wires (not shown) which are moved in back and forth manner by a plurality of actuating coils (also not shown) in printing operation. The print head operates in a compact environment and generates an amount of heat that must be transferred or transmitted away from the print head for efficient operation.

The means for transferring or dissipating heat from the print head 40 is effected with and comprises a heat sink, generally at 42. The die cast aluminum heat sink 42 generally covers and surrounds the actuating or rear portion 44 of the print head 40. The heat sink 42 includes a top plate portion 46, a right hand plate portion 48, and a left hand plate portion 50. The heat sink 42 is of unitary construction and includes ribs 52 on the exterior of plate portion 48 and ribs 54 on the exterior of plate portion 50. The heat sink 42 also includes ribs 56 formed in an arcuate arrangement which bridges the side plate portion 48 and the top plate portion 46. Ribs 58 are formed in an arcuate arrangement and bridge the side plate portion 50 and the top plate portion 46. The top plate portion 46 extends to the right in FIG. 1 and covers the nose portion 60 of the print head 40.

The heat sink 42 includes a pair of doglegs 62 and 64 at the right hand side thereof. A pivot pin 66 is secured to the doglegs to provide for swinging movement of the heat sink. The carriage 24 has a bearing 68 as an integral part at the right hand side thereof and of a length occupying the space between the doglegs 62 and 64. The bearing 68 and the pivot pin 66 provide means for swinging the heat sink 42 from a position covering the print head 40 to a position wherein the print head is uncovered for the purpose of servicing the print head or for removal thereof.

A latch or clamp 70 is provided at the left hand side of the heat sink 42 to maintain the heat sink in position during printing operation. The carriage 24 has a pair of spaced bearings 72 as an integral part at the left hand side thereof, and the latch or clamp 70 is formed in wire bail manner and has ends 74 journaled in the bearings 72. The latch or clamp 70 is formed with a curved portion 76 to fit over a ledge 78 of the heat sink 42. The wire bail construction of the latch 70 provides for maintaining the heat sink 42 in a secure position by reason that as the heat sink is started to be raised by an operator or other person from the operational mode position, the latch exerts an increased force on the ledge 78 to retain the parts in position.

An additional feature of the print head assembly is the provision of a knife mechanism 80 for use in receipt printing operation. The knife mechanism 80 includes a solenoid 82 coupled with a crank arm 84 that is journaled at pivot 86. A bifurcated arm 88, as an integral part of the crank arm 84, supports a knife blade 90 which is movable to a cutting position for severing the receipt paper. A detailed description of the knife mechanism is found in Shipos et al. Pat. No. 4,525,088.

If the knife mechanism is not required in the printing operation, a modification of the print head assembly includes the carriage 24, the print head 40, and the heat sink 42. FIG. 3 illustrates the print head and the swingable heat sink but does not show the knife mechanism.

It is thus seen that herein shown and described is a print head assembly that includes a swingable heat dissipating element. The mechanism and arrangement enable the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A print head assembly comprising:

a carriage movable along guide means in transverse direction, a print head carried on said carriage, heat transfer means formed to cover and to substantially surround said print head for transferring heat generated by said print head therefrom, said carriage including first integral bearing means comprising an elongated bearing on one side of said carriage and said heat transfer means having pivot means coupled with said first integral bearing means, said pivot means comprising an elongated pin journaled in said elongated bearing for allowing swinging of said heat transfer means from a position covering said print head to a position uncovering said print head to permit removing said print head from said carriage, said carriage including second integral bearing means on the other side thereof, and clamping means pivoted to said second integral bearing means on said other side of said carriage and coupled to said heat transfer means and positioned on the side opposite said first integral bearing means on said one side of said carriage for retaining said heat transfer means in the print head covering position.

2. The print head assembly of claim 1 including a knife mechanism affixed to said heat transfer means.

3. The print head assembly of claim 1 wherein said heat transfer means comprises a heat sink defining ribs on either side of said print head.

4. The print head assembly of claim 1 wherein said clamping means comprises a spring wire clamp pivotable on said carriage and engageable with said heat transfer means on the side opposite said first integral bearing means.

5. The print head assembly of claim 3 wherein said heat sink comprises an element of unitary construction and defines a plurality of ribs in arcuate form adjacent said print head.

6. The print head assembly of claim 3 wherein said heat sink is die cast of aluminum material.

7. In a printer having guide means, a carriage movable along said guide means for carrying a print head in transverse manner for printing on record media, the improvement comprising heat transfer means operably associated with said print head for transferring heat therefrom, said heat transfer means substantially covering said print head, and said carriage including first integral bearing means comprising an elongated bearing on one side of said carriage and coupled with said heat transfer means for providing pivot means comprising an elongated pin journaled in said elongated bearing for swinging of said heat transfer means from a position covering said print head to a position uncovering said print head to permit removal thereof from said carriage, said carriage including second integral bearing means on the other side thereof, and clamping means pivoted to said second integral bearing means on said other side of said carriage and coupled to said heat transfer means and positioned on the side opposite said first integral bearing means on said one side of said carriage for retaining said heat transfer means in the print head covering position.

8. In the printer of claim 7 including a knife mechanism affixed to said heat transfer means.

9. In the printer of claim 7 wherein said heat transfer means comprises a heat sink defining ribs on either side of said print head.

10. In the printer of claim 7 wherein said clamping means comprises a spring wire clamp pivotable in said second integral bearing means on said other side of said carriage and engageable with said heat sink on the side opposite said first integral bearing means on said one side of said carriage.

11. In the printer of claim 9 wherein said heat sink comprises an element of unitary construction and defines plate portions with ribs molded in arcuate form adjacent said print head.

12. In the printer of claim 9 wherein said heat sink comprises an element of unitary construction and defines a top plate portion and right and left side plate portions with ribs molded in arcuate form and bridging the top plate portion and the side plate portions.

13. A dot matrix print head assembly comprising a carriage movable along guide means in transverse direction, a print head carried on said carriage, a heat sink substantially surrounding said print head for dissipating heat generated by said print head, said carriage including first integral bearing means comprising an elongated bearing on one side of said carriage and second integral bearing means on the other side thereof and said heat sink having pivot means comprising an elongated pin journaled in said elongated bearing and coupled with said first integral bearing means for allowing swinging of said heat sink from a position covering said print head to a position uncovering said print heat to permit removing said print head from said carriage, and a spring clamp pivoted to said second integral bearing means of said carriage and coupled to said heat sink and positioned on the side opposite said first integral bearing means of said carriage for retaining said heat sink in the print head covering position.

14. The dot matrix print head assembly of claim 13 wherein said heat sink defines a plurality of ribs on either side of said print head.

15. The dot matrix print head assembly of claim 13 wherein said heat sink comprises an element of unitary construction and defines a plurality of ribs in arcuate form adjacent said print head.

16. The dot matrix print head assembly of claim 13 wherein said heat sink comprises an element of unitary construction and defines a top plate portion and right and left side plate portions having ribs molded in arcuate form and bridging the top plate portion and the right and left side plate portions.

* * * * *